US005208507A

United States Patent [19]

Jung

[11] Patent Number: 5,208,507

[45] Date of Patent: May 4, 1993

[54] IN-LINE TYPE ELECTRON GUN ENABLING EASY CENTERING BETWEEN MAIN ELECTRODE AND AUXILIARY ELECTRODE

[75] Inventor: Injae Jung, Kyunggi-do, Rep. of Korea

[73] Assignee: Samsung Electron Devices Co., Ltd., Kyunggi-do, Rep. of Korea

[21] Appl. No.: 800,143

[22] Filed: Nov. 27, 1991

[30] Foreign Application Priority Data

Dec. 6, 1990 [KR] Rep. of Korea ..... 90-19382

[51] Int. Cl.[5] ..... H01J 29/54; H01J 29/02

[52] U.S. Cl. ..... 313/414; 313/412; 313/425; 313/426; 313/460; 313/452

[58] Field of Search ..... 313/412, 414, 415, 417, 313/425, 426, 460, 449, 452, 436

[56] References Cited

U.S. PATENT DOCUMENTS 4,181,870 1/1980 Stevens ..... 313/414
4,443,736 4/1984 Chen ..... 313/414
4,899,091 2/1990 Odenthal ..... 313/414 X

*Primary Examiner*—Donald J. Yusko
*Assistant Examiner*—Ashok Patel
*Attorney, Agent, or Firm*—Christie, Parker & Hale

[57] ABSTRACT

A screen electrode of an electron gun is by uniting main electrode with an auxiliary electrode. The main electrode has three circular beam passing holes and a pair of guide holes for insertion in arbors of a jig disposed symmetrically around a center beam passing hole thereof. The auxiliary electrode has three elongated beam passing holes and a pair of guide slots for insertion in the arbors of the jig formed in a top edge and a bottom edge of the auxiliary electrode and coaxially positioned with the guide holes, thereby enabling easy centering of the main and auxiliary electrodes.

3 Claims, 4 Drawing Sheets

IN-LINE TYPE ELECTRON GUN ENABLING EASY CENTERING BETWEEN MAIN ELECTRODE AND AUXILIARY ELECTRODE

FIELD OF THE INVENTION

The present invention relates to an electron gun structure for a color cathode ray tube, and specifically to in-line type electron gun wherein the centering process between the main electrode and the auxiliary electrode is rendered easier in assembling.

BACKGROUND OF THE INVENTION

An electron gun for use in a color cathode ray tube consists of a plurality of electrodes for focusing and accelerating the thermionic electrons emitted from a cathode, thereby forming electron beams. These electrodes each include respectively, three beam apertures through which RED, GREEN and BLUE(R, G, B) beams pass.

The electron beams projected from the electron gun toward the picture screen are deflected by the electric field generated from a deflection yoke so that the beams may be scanned toward the picture screen, thereby forming a picture.

For the pictures of the color cathode ray tube to be made clear, the size and shape of spots formed by beams striking the screen surface must be uniform at all the places thereon.

However, conventional cathode ray tubes have a basic problem that the distance between the electron gun and the edge of the screen thereof is longer than that between the electron gun and the center of the screen. Further, the irradiation angles of the beams are sharper at the edge than at the center, and therefore, the edge of the screen produces diagonally elongated beam spots, thereby reducing the picture quality.

As one method of overcoming this problem, Hsing-Yao Chen U.S. Pat. No. 4,443,736, Apr. 17, 1984, proposes a dynamic focus-type electron gun wherein auxiliary electrodes which have a vertical slot or a horizontal slot are installed respectively in front of and behind a screen electrode and which selectively apply voltage to each auxiliary electrode according to the scanning position on the screen. Whereas this kind of electron gun can form nearly uniform spots, regardless of the center and edge of the screen, it has a disadvantage that considerable complex circuit structure must be required for applying voltage or not applying voltage to each auxiliary electrode according to the scanning position of the beams.

Thus, generally, a method of forming a nearly circular spot on the edge of the screen has been used in practice. This method is to install the auxiliary electrode having an elongated beam hole at one side of the screen electrode.

FIG. 5 is an example of a commercially used screen electrode structure of an electron gun in which an auxiliary electrode 8 having elongated beam holes 6R,6G,6B is installed at the main electrode having circular beam holes 2R,2G,2B. This auxiliary electrode 8 is welded to and united with the main electrode 4. In this kind of screen electrode, voltage equal to that applied to the main electrode 4 is applied to the auxiliary electrode 8 without relation to the beam scanning position of the screen, so that all the electron beams passing therethrough are focused in the elongated beam type. As a result, whereas the elongated spot is formed on the center of the screen, the same is changed into the nearly circular spot at the edge of the screen, so that as a whole, uniform picture quality can be obtained.

Meanwhile, in the assembling process of the screen electrode having only the main electrode 4 and the auxiliary electrode 8, improper centering between beam holes 2R and 6R, 2G and 6G, 2B and 6B coaxially aligned causes an extending flare both above and below the core of the beam spot on the screen.

The conventional screen electrode as shown in FIG. 5 does not have means for the precise centering of the beam holes, so that relatively high skill in assembly is needed, yet a poor quality ratio is comparatively high.

SUMMARY OF THE INVENTION

Accordingly, one feature of the present invention is to provide a screen electrode of an in line type electron gun, in which the centering between a main and auxiliary electrode is rendered easier, so that the beam passing holes of the main and auxiliary electrode may be exactly aligned. To provide this feature, the electrode structure according to the present invention comprises a main electrode in which a pair of guide holes are symmetrically disposed on opposite sides of a center beam passing hole and inserted in arbors of a jig, and an auxiliary electrode in which a pair of guide slots are disposed at the positions corresponding to those of the guide holes inserted in the arbors of the jig. The electrodes can be quickly and easily centered by the jig through which the guide holes and guide slots are penetrated.

BRIEF DESCRIPTION OF THE DRAWINGS

Further features and advantages of the present invention will be more apparent in the following detailed description of the present invention in connection with the accompanying drawings in which.

DESCRIPTION OF THE PREFERRED EMBODIMENT

Figure 1:
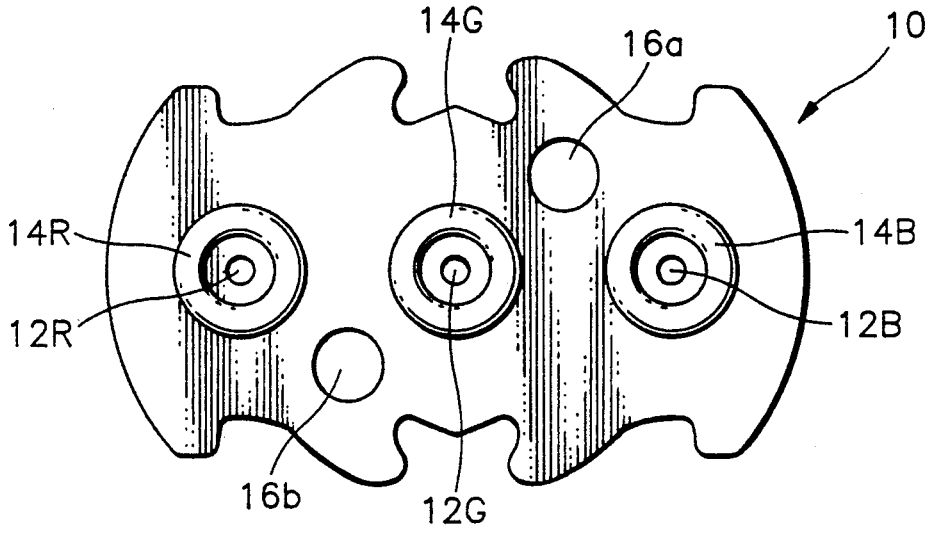
FIG. 1 is a front view of a main electrode of the present invention.

FIG. 1 illustrates in a front view a main electrode forming one element of the present invention, and as shown in this drawing, the main electrode 10 is provided with three spaced-apart circular R, G, B beam passing holes 12R, 12G, 12B. Beads 14R,14G,14B are formed adjacent the beam passing holes by the coining process. These beads are used for reinforcement of circumferential strength of the beam passing holes 12R,12G,12B so that, even though the main electrode 10 is deformed by the external pressure, this pressure may not have influence up to the beam passing holes.

At the opposite sides of the center beam passing hole 12G of the main electrode 10, and offset in the diagonal direction, there are formed a pair of guide holes **16*a*, 16*b*. The guide holes are arranged symmetrically with respect to the center passing hole 12G. One guide hole is disposed between and below the left and center passing holes 12R,12G, while the other guide hole is disposed above and between the right and center passing holes 12B,12G**.

Figure 2:
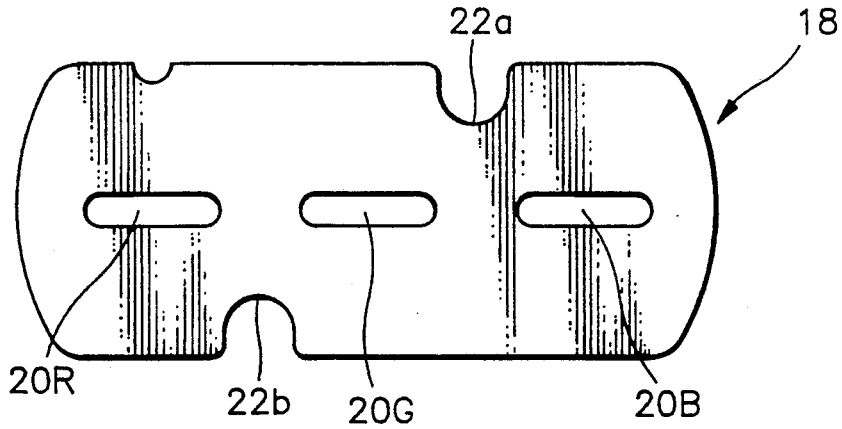
FIG. 2 is a front view of an auxiliary electrode of the present invention.

FIG. 2 illustrates in a front view an auxiliary electrode forming another element of the present invention, and as shown in this drawing, the auxiliary electrode 18 is provided with longitudinally elongated R, G, B beam passing holes 20R, 20G, 20B. Further, at symmetrically opposite sides of the center beam passing hole 20G of the auxiliary electrode 18, and diagonally offset therefrom, there are formed a pair of guide slots **22*a*, 22*b*** in a symmetrical manner.

One guide slot **22*a* is formed in one horizontal side edge 24 of the auxiliary electrode 18 at a location above and between the center and right beam passing holes 20G,20B of the auxiliary electrode. The other guide slot 22*b* is formed in another horizontal side edge 26 of the auxiliary electrode 18 at a position below and between the left and center beam passing holes 20R,20G**.

The guide slots **22*a*,22*b* of the auxiliary electrode 18 and the guide holes 16*a*,16*b* of the main electrode 10 are disposed such that they can be coaxially aligned. Further, the guide slots 22*a*,22*b* are larger overall than a diameter of the guide holes 16*a*,16*b*** and preferably have a semi-circular shape.

Figure 3:
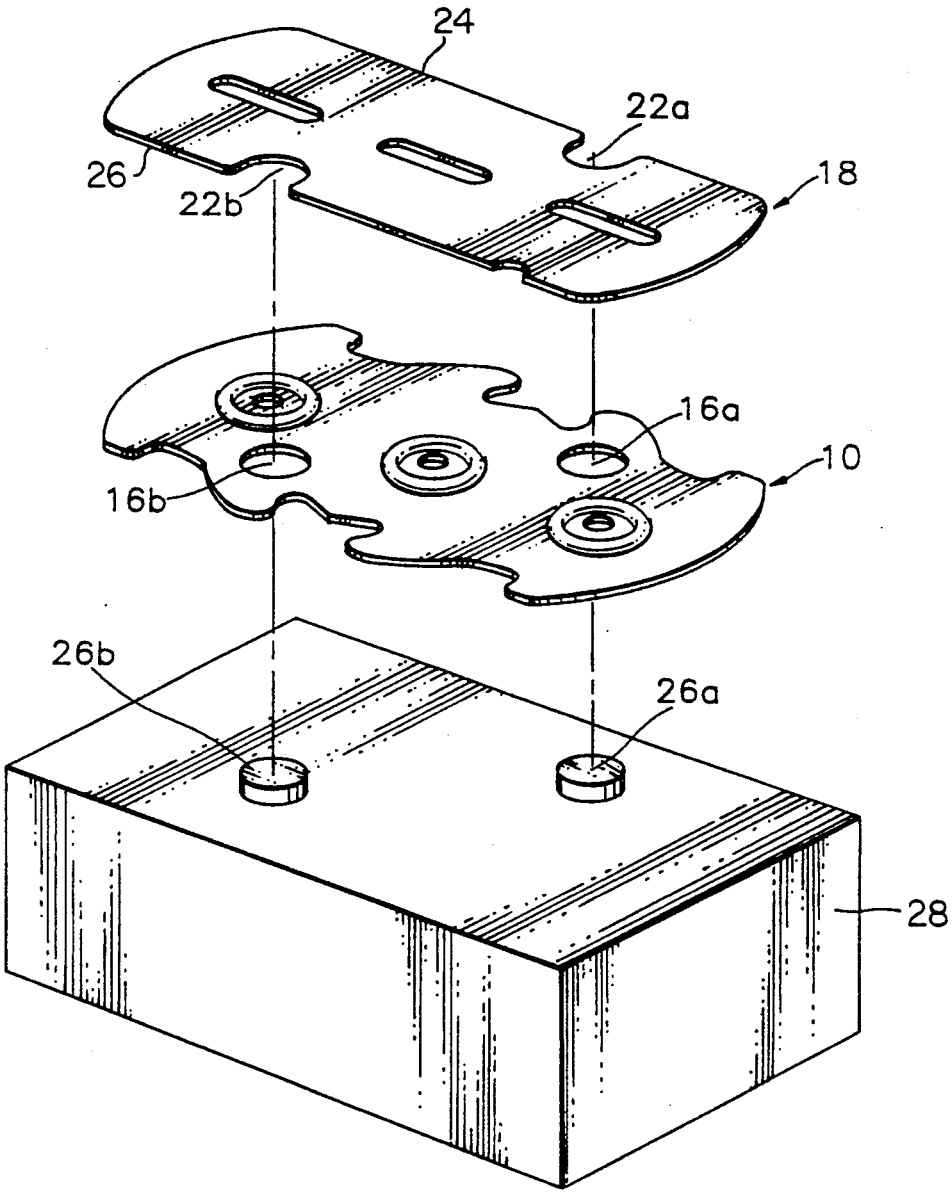
FIG. 3 is an exploded perspective view of the assembly process of a main and auxiliary electrode of FIGS. 1 and 2 by a jig.

FIG. 3 illustrates in an exploded perspective view an example of assembly or the main and auxiliary electrode in which a pair of arbors **26*a*,26*b* are upwardly protruded from the jig 28. The guide grooves 16*a* 16*b* of the main electrode 10 respectively penetrated through the arbors 26*a*,26*b*, and the guide slots 22*a*,22*b* of the auxiliary electrode 18 are inserted thereinto again, so that the assembly of the main and auxiliary electrode 10,18 is finished. The upright height of the arbors 26*a*,26*b* from the jig 28 is slightly longer than the thickness formed by joining the main electrode 10 to the auxiliary electrode 18, so that the much simpler assembly can be obtained. Namely, the remaining upright height of the arbors 26*a*,26*b* after the guide holes 16*a*,16*b* of the main electrode 10 are penetrated through the arbors 26*a*, 26*b* is slightly longer than the thickness of the auxiliary electrode 18, so that the work of inserting into and adapting to the arbors 26*a*,26*b* the slots 22*a*,22*b* becomes easy. A worker skilled in the conventional method can easily perform such assembly process. The main and auxiliary electrodes 10,18** arranged on the jig in such method are welded to and united with each other, thereby forming the screen electrode. The assembly is then removed from the jig.

Figure 4:
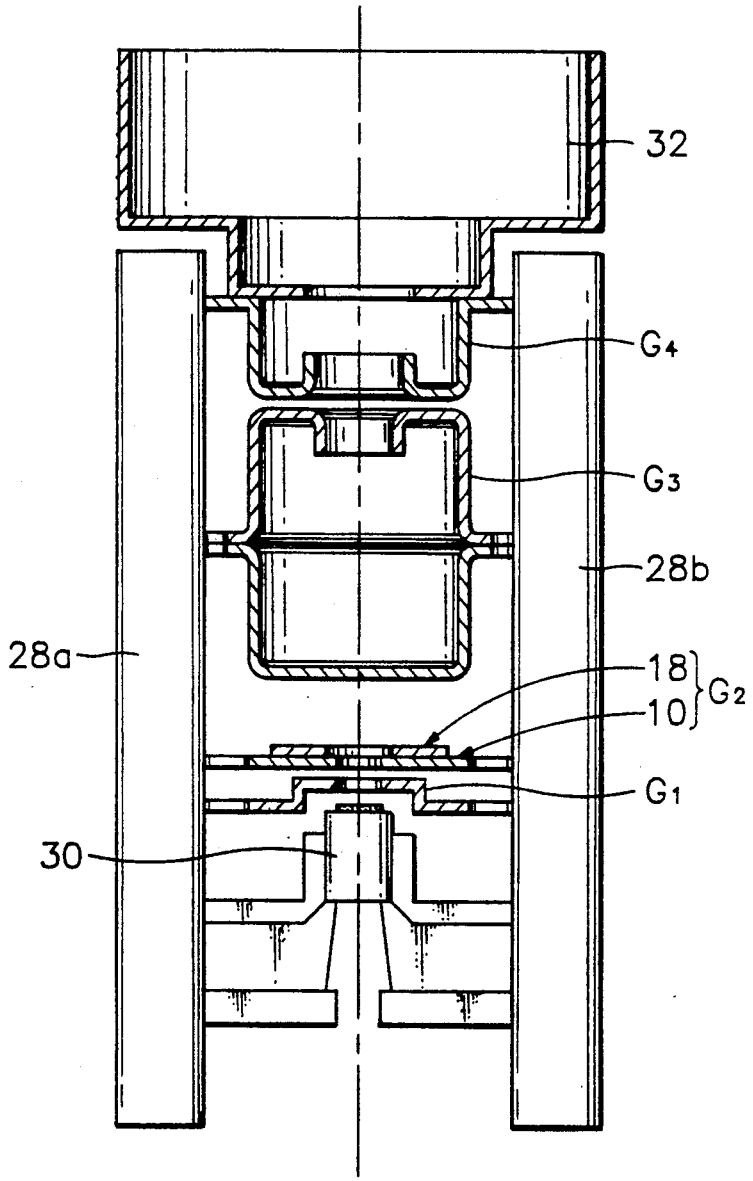
FIG. 4 is a sectional view of an electron gun structure provided with a screen electrode of the present invention.
Figure 5:
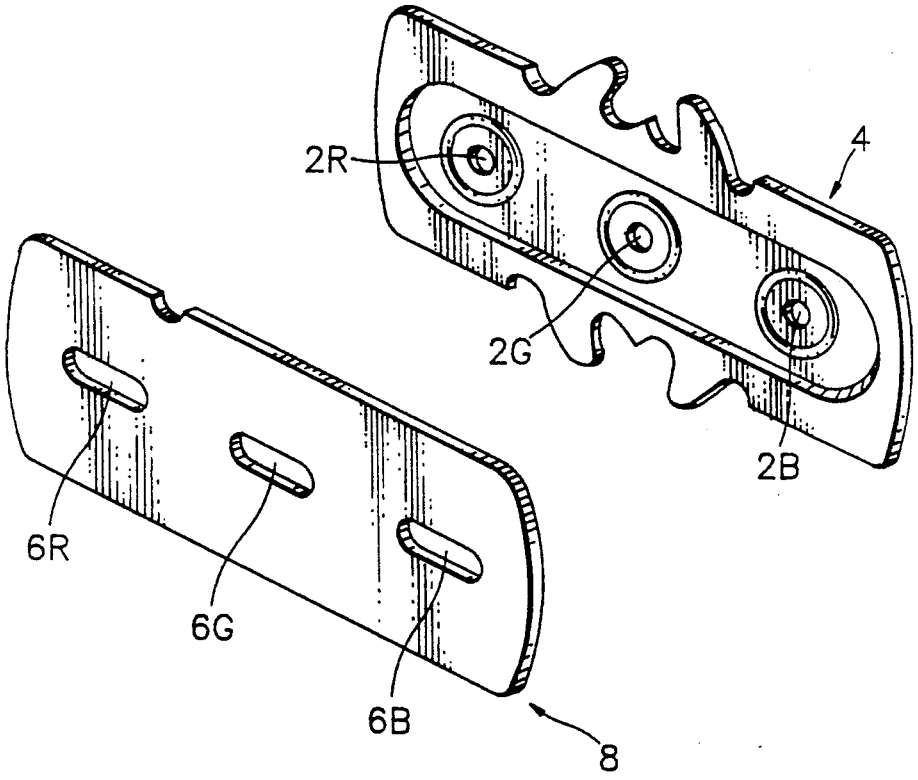
FIG.5(Prior Art)
FIG. 5 is an exploded perspective view of a conventional screen electrode

FIG. 4 illustrates in a sectional view an electron gun structure provided with the screen electrode of the present invention in which a cathode 30, first, second, third and fourth electrodes G1,G2,G3,G4, respectively, are disposed between two bead glasses **28*a*,28*b* in a predetermined spaced relationship, and a shield cup 32 is attached to one end of the fourth electrode G4. In this gun, the second electrode G2** is the screen electrode of the present invention.

In the electron gun provided with the present invention, as with the conventional gun, the thermionic electron emitted from the cathode 30 is focused and accelerated between the first and second electrode G1,G2 and converged between the third and fourth electrodes G3,G4 to form beam spots on the screen. In this process, there are formed the elongated distorted spots on the center of the screen by the elongated beam passing holes 20R,20G,20B of the auxiliary electrode 18 constituting the second electrode G2 and the nearly circular spot on the edge of the screen.

However, in the fabrication process of the present invention, high precision centering of the beam passing holes of the main and auxiliary electrode can be obtained to improve the picture quality and the easy and simple production operation can be performed, thereby obtaining the improved productivity.

What is claimed is:

1. A screen electrode structure for an in-line type electron gun of a color cathode ray tube comprising:

a main electrode and an auxiliary electrode, the main electrode comprising two circular side beam passing holes and a circular center beam passing hole, and a pair of guide holes disposed symmetrically around horizontal and vertical axes of the center beam passing hole in the main electrode and the auxiliary electrode comprising two elongated side beam passing holes and an elongated center beam passing hole, and a pair of guide slots formed in a top edge and a bottom edge of the auxiliary electrode and coaxially positioned and aligned with said guide holes, said main and auxiliary electrodes being in contact with each other for providing a centered integral structure thereof.

2. The electrode structure as claimed in claim 1, wherein said guide slots of said auxiliary electrode have a semi-circular shape having a radius larger than a radius of said guide holes of said main electrode.

3. The electrode structure as claimed in claim 1, wherein the guide holes of the main electrode and the guide slots of the auxiliary electrode are symmetrically aligned around the center beam passing hole thereof.

* * * * *